US010488159B2

(12) United States Patent
Campbell et al.

(10) Patent No.: US 10,488,159 B2
(45) Date of Patent: Nov. 26, 2019

(54) METHOD, SYSTEM AND APPARATUS FOR IMPLEMENTING SHOOTING SPORTS

(71) Applicants: Mark D. Campbell, Santa Clara, CA (US); Michael P. Campbell, Valencia, CA (US)

(72) Inventors: Mark D. Campbell, Santa Clara, CA (US); Michael P. Campbell, Valencia, CA (US)

(73) Assignee: ADVANCED TARGET TECHNOLOGIES IP HOLDINGS INC, Valencia, CA (US)

( * ) Notice: Subject to any disclaimer, the term of this patent is extended or adjusted under 35 U.S.C. 154(b) by 0 days.

(21) Appl. No.: 15/246,359

(22) Filed: Aug. 24, 2016

(65) Prior Publication Data

US 2017/0059288 A1 Mar. 2, 2017

Related U.S. Application Data

(60) Provisional application No. 62/283,387, filed on Aug. 31, 2015.

(51) Int. Cl.

| | |
|---|---|
| ***F41J 7/04*** | (2006.01) |
| ***F41J 5/04*** | (2006.01) |
| ***F41J 7/06*** | (2006.01) |
| *F41J 5/14* | (2006.01) |

(52) U.S. Cl.

CPC . *F41J 7/04* (2013.01); *F41J 5/04* (2013.01); *F41J 7/06* (2013.01); *F41J 5/14* (2013.01)

(58) Field of Classification Search

CPC . F41J 7/04; F41J 7/02; F41J 7/06; F41J 1/00; F41J 5/04; F41J 5/056; F41J 5/14

USPC ..... 273/390–392, 406, 407

See application file for complete search history.

(56) References Cited

U.S. PATENT DOCUMENTS

| | | | | |
|---|---|---|---|---|
| 4,524,976 | A * | 6/1985 | Seitz | F41J 7/04 273/388 |
| 4,979,752 | A * | 12/1990 | Fosseen | F41J 7/04 273/392 |
| 5,263,722 | A | 11/1993 | Rosellen | |
| 5,575,479 | A | 11/1996 | Ayres | |
| 7,114,725 | B2 | 10/2006 | Camp | |
| 7,175,181 | B1 | 2/2007 | Bateman | |
| 7,661,679 | B2 | 2/2010 | Mah | |
| 8,523,185 | B1 | 9/2013 | Gilbreath | |
| 8,545,226 | B2 | 10/2013 | Norden | |
| 8,814,168 | B2 | 8/2014 | Davis | |
| 9,157,706 | B2 | 10/2015 | Shea | |
| 9,163,912 | B1 | 10/2015 | Stark | |
| 9,170,077 | B2 | 10/2015 | Johnson | |
| 9,303,959 | B2 | 4/2016 | Doria | |
| 9,303,960 | B2 | 4/2016 | Uhr | |
| 9,360,283 | B1 | 6/2016 | Tejada | |
| 9,389,049 | B2 | 7/2016 | Hotter | |
| 2002/0183141 | A1 * | 12/2002 | Ouimette | A63B 63/06 473/454 |

(Continued)

*Primary Examiner* — Mark S Graham

(74) *Attorney, Agent, or Firm* — Adrian Hocking; Albright IP

(57) ABSTRACT

A computerized shooting target system comprising a pivotal target, electromagnet, sensors, optional portable power supply and transceiver. Sensors on the target register a hit and transmit data to a computer. The computer processes hit information and sends instructions back to the target.

11 Claims, 5 Drawing Sheets

(56) References Cited

U.S. PATENT DOCUMENTS

| | | | | |
|---|---|---|---|---|
| 2005/0098954 | A1* | 5/2005 | Stutz | F41J 7/04 273/390 |
| 2010/0038854 | A1* | 2/2010 | Mraz | F41J 5/056 273/371 |
| 2011/0175293 | A1* | 7/2011 | Brune | F41J 7/04 273/406 |
| 2015/0102563 | A1* | 4/2015 | Gwash | F41J 7/06 273/390 |
| 2015/0260487 | A1* | 9/2015 | Steil | F41J 7/04 273/390 |

* cited by examiner

METHOD, SYSTEM AND APPARATUS FOR IMPLEMENTING SHOOTING SPORTS

RELATED APPLICATIONS

This application claims priority from U.S. Provisional Application No. 62/283,387 filed Aug. 31, 2015, which is incorporated by reference.

FIELD OF THE INVENTION

The present invention relates to targets used for target practice. More specifically, this invention relates to how a target is magnetically captured and released after it is hit by a projectile, how it presents backlit colors to indicate its status (explained in detail below) and through the collective behavior of several connected targets the method of using the above mentioned features as a system for creating training simulations and game modes using a main controller operating the target assemblies over radio frequency (RF) links.

BACKGROUND OF THE INVENTION

There is a need in shooting sports to add dynamism and interactivity over the static presentation of the average shooting range and target systems currently offered. Shooting ranges generally consist of paper and steel targets. Paper targets show penetration marks from the projectiles, but otherwise provide little reactive feedback to the shooter that a hit was registered. Steel targets ping loudly and are often more enjoyable to shoot than paper targets as a result.

U.S. Pat. No. 9,389,049 issued to Hoetger Jul. 12, 2016 relates to a target assembly that uses a pressurized container as a target. The container must be replaced after each strike.

U.S. Pat. No. 9,360,283 issued Jun. 7, 2016 to Tejada, et al., requires punctures in a target in order to detect hits and calculate hit position using cameras as the hit detection sensor. The present target system does not require a camera.

U.S. Pat. No. 9,303,960 issued to Uhr Apr. 5, 2016, relates to an electronic target for use with a pulsed beam of laser light. This target is not suitable for use with physical projectiles.

U.S. Pat. No. 9,303,959 issued to Doria Apr. 5, 2016 relates to a portable paper target and holder, that may further include a non-paper target, which can be a metal plate. No use of an electromagnet is disclosed.

U.S. Pat. No. 9,170,077 issued to Johnson, et al. Oct. 27, 2015 relates to a shooting target with reactive zones, which is a paper target. The reactive features of the present invention do not include paper or ink.

U.S. Pat. No. 9,163,912 issued to Stark Oct. 29, 2015 relates to a reactive target having a plurality of paddles that rotate around a target arm; impact on a target paddle removes the paddle from the target arm. This patent discloses a dueling mode of operation where a paddle struck on one target assembly can trigger a release of a paddle on a separate target assembly. The present invention does not remove a target when the target is struck, and its dueling mode is software driven.

U.S. Pat. No. 9,157,706 issued to Shea Oct. 13, 2015 relates to a target assembly that provides moving and turning targets. The present invention does not require targets to be in motion.

U.S. Pat. No. 8,814,168 issued to Davis Aug. 26, 2014 relates to a fluid-filled target that emits colored fluid when struck.

U.S. Pat. No. 8,545,226 issued to Norden, et al., Oct. 1, 2013, relates to a processor-controlled gaming system that relies on image capture to detect the accuracy of a hit.

U.S. Pat. No. 8,523,185 issued to Gilbreath, et al., Sep. 3, 2013 relates to an electronic target shooting system that uses an image capture system, and does not use the target of the present invention. The target in the reference invention does not pivot, and does not involve use of an electromagnet.

U.S. Pat. No. 7,661,679 issued to Mah, et al. Feb. 16, 2010 relates to a shooting target assembly that electronically detects successful shots through the aperture of a target frame, and the frame may have colored lights on its front face. The present invention does not include a frame or aperture, or means of detecting a projectile passing through an aperture.

U.S. Pat. No. 7,175,181 issued to Bateman, et al., Feb. 13, 2007, relates to a portable target that pivots upon being struck, and immediately returns to the original position. This assembly uses two arms with two target plates that swing rearwardly or forwardly. The present invention uses a single arm with a single target plate that pivots rearwardly only and is spring drawn to return to its original position only after it receives an instruction to do so.

U.S. Pat. No. 7,114,725 issued to Camp, et al., Oct. 3, 2006 relates to a vertical rotary shooting target having a stand with a horizontally extending axial [sic] which supports a rotary target structure. The vertical rotary target structure includes a hub rotatably mounted on the axial, a pair of target impact plates, and a support structure connecting the impact plates radially outwardly on diametrically opposed sides of the hub and horizontally spaced relation for enhanced shooting difficulty. The targets in this patent are always visible to the shooter.

The present invention has a single target plate that rotates about 90 degrees and is stopped when it connects with the electromagnet. A advantage of the present invention is that when the target plate is down, it is not visible to the shooter.

U.S. Pat. No. 5,575,479 issued to Ayres Nov. 19, 1996 relates to a projectile impact indicating target that includes a frame, a projectile impact sensor mounted on the frame for sensing projectile impact, and an impact indicator releasably restrained by the projectile impact sensor for indicating projectile impact with the target. This patent uses non-reusable rupturing sensors to indicate impacts.

U.S. Pat. No. 5,263,722 issued to Rosellen Nov. 23, 1993 relates to an automatically resettable target. A plurality of individual targets or bullseyes that are adapted to be thrown out of their normal positions when struck by a bullet or other projectile with the means for automatically resetting the individual targets to their normal positions, also by the impact of a bullet or other projectile which allows for continuous target shooting without the necessity of manually resetting the target apparatus. Plate resetting for the reference is handled by mechanical actuation either by lever or bullet strike. The present plate resets are handled by a solid state electromagnet which when power is turned off the magnet, the target plate is released and a spring draws the plate back to is vertical position.

There are mechanical targets using pneumatic and other piston driven technologies, actuating mechanisms and electric motors to raise and lower a target plate. This helps to provide more interactivity and feedback to the shooter, but these designs are often large, heavy, specialized and expensive to purchase and maintain. Moreover these mechanical targets often have delayed feedback to the shooter due to the target raising and lowering mechanics. What is needed here is a target that when struck provides rapid feedback to the shooter that the target was hit and a rapid rising response to clearly present to the shooter a target is on the range.

Steel targets suffer from the need of continually needing to be refreshed with spray paint in order to see them at longer distances. This can cause delays or even risk to shooters on a range when shooters are walking into the shooting area to repaint a target face.

What is needed is a portable target assembly that reduces the complexity and weight of a mechanical or electrically actuated target system, improves on the feedback and presentation during projectile strikes so that the target face lowers and rises rapidly and can be better visible.

It is also needed at the present time for better portability of targets that can use batteries to power themselves and use RF links to eliminate cables to and from the remote or main controller.

SUMMARY OF THE INVENTION

This invention describes a computerized shooting target system applying game mechanics on the feedback mechanisms of the target assembly. The system can be configured to be portable. Sensors on the target assembly register a hit and transmit data to a computer. The computer processes hit information and sends instructions back to the target to produce certain behaviors, either lighting the face of the target and/or controlling orientation of target face.

The target assembly, designed for sport shooting and training, comprises a target face that when hit by a projectile, pivots the target face around a shaft connected to the target base, or swung from where it is tethered until it reaches a horizontal position and is stopped and retained by an electromagnet. The electromagnet is fixed to the base plate of the target assembly platform. When power is supplied to the coils of the electromagnet, the attractive force captures the steel target plate and holds it in a retracted position preventing it from returning to its vertical position. The steel target plate or iron core fixture attached to a target plate acts as the iron core closing the loop of the magnetic field of the electromagnet. When power to the electromagnet is switched off, the target face is released from the magnetic force of the electromagnet and the target moves back to its vertical position whether drawn back by a spring around the shaft pivoting the target face back to its vertical position or by use of gravity to reset the target face. Power supplied back to the electromagnet puts it back into a ready state to receive the target face whenever the projectile strikes the target plate.

In one embodiment, the target base and target plate along with the electromagnet is connected to a local power source, microcontroller and transceiver. A sensor may be attached to the target base or plate to register a hit by a projectile. The registered hit is communicated to a main controller whereby the main controller may send an instruction back to cut power to the electromagnet and release the target plate.

The target plate contains, in a preferred embodiment, a ring of fiber optic filament embedded within the steel with light projected from the rear so that the front of the target is lit and is clearly visible to the shooter that the target is upright and what color is being displayed.

BRIEF DESCRIPTION OF THE DRAWINGS

Various embodiments and features of target systems shown and described in reference to the following numbered drawings.

DETAILED DESCRIPTION OF THE DRAWINGS

Figure 1:
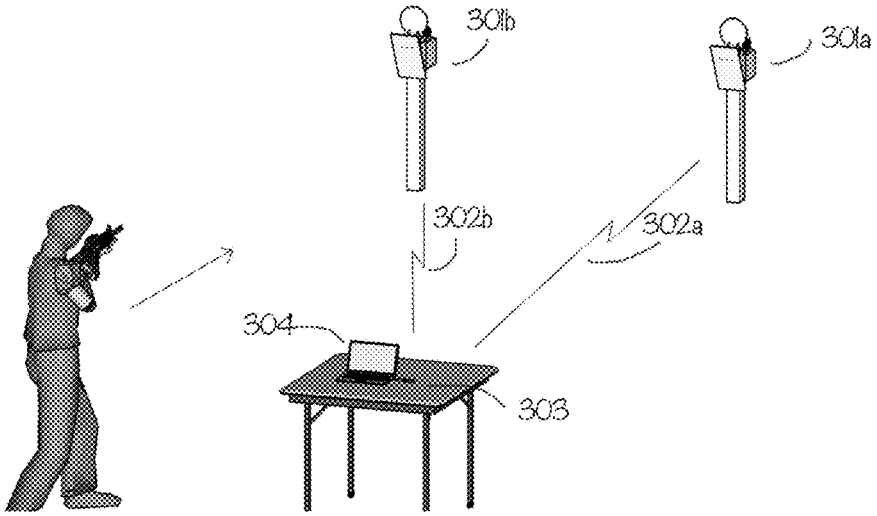
FIG. 1 shows a perspective view of an exemplary embodiment of a target system on a target range.

FIG. 1 shows a laptop or tablet controller (304) connected to a transceiver (303). The transceiver (303) is connected to a variable number of target assemblies 301(*a,b*) over radio frequency ("RF") links 302(*a,b*). Target shooters may position the target assemblies 301(*a,b*) in any desired position within 100 meters from the controller (304) and transceiver (303).

Figure 2:
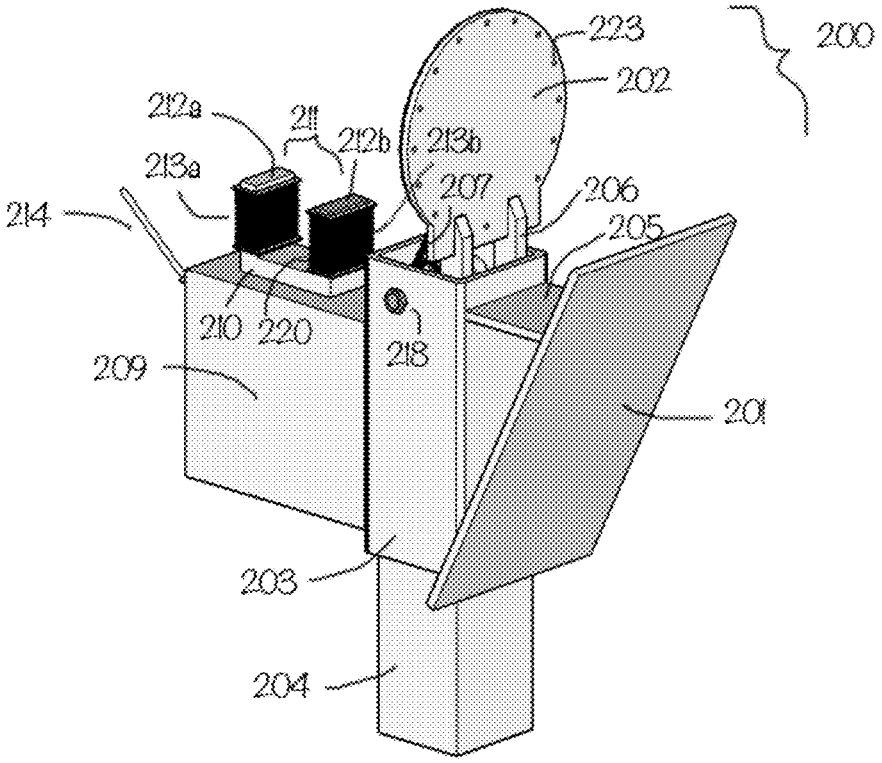
FIG. 2 shows a forward perspective view of a target assembly
Figure 3:
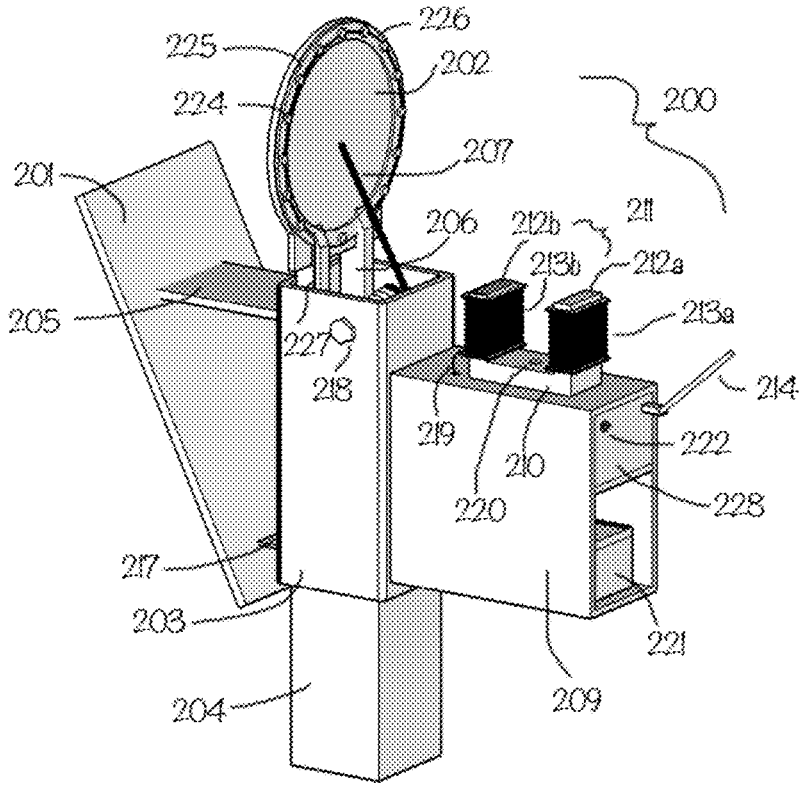
FIG. 3 shows a rear perspective of the target assembly of FIG. 2.

FIG. 2 (front perspective) and FIG. 3 (rear perspective) show a an exemplary embodiment of target assembly (200) mounted on post (204). The portable target assembly (200) comprises a 6 inch target plate (202) connected to target base (203). An angled protection plate (201) is a hard steel capable of deflecting projectiles that miss the target plate (202) and preventing any damage to the electromagnet (211) and other hardware behind plate (201). The protection plate (201) is welded to base (203) by brackets (205) and (217) (217 not shown in FIG. 2). Base (203) is mounted on a vertically oriented 4×4 post (204) as a means to elevate the target assembly. Other embodiments could utilize a horizontally oriented 4×4 post. A protective housing (209) holds the battery (221) (not shown in FIG. 2) and partition (228) (not shown in FIG. 2) which contains the circuitry (not shown), a target assembly transceiver (214) for the RF link (not shown), and microcontroller (not shown). The protective housing (209) is also made of a hard steel welded to base (203) and capable of withstanding impacts from projectiles.

The electromagnet (211) comprises a magnet core (210) preferably made from stacked laminated electrical steel sheets in a U (shown) or E (not shown) core configuration. A preferred embodiment of the steel sheet material is around a 24 gauge silicon steel for maximum strength and magnetic flux. 50 sheets laminated together providing an overall thickness of 1 and ½ inches. The overall length of the electromagnetic core runs optimally at 3 inches in length and 2 and ½ inches tall for a 6 inch plate with larger cores for larger sized plates. The magnet core can be reinforced by using harder materials such as cobalt or by welding the laminates together or by riveting the laminates together. Each leg of the magnet core 212(*a,b*) holds an electromagnetic coil or winding (213*a,b*). When the face of the target plate (202) is hit by a projectile, the plate articulates around the shaft (218) until the target plate 202 connects with the top of the magnet core 200 legs (212 *a,b*). This connection closes the loop of the magnetic field and holds the target plate down until power to the coils (213*a,b*) is cut. At that point, the spring (207) draws the target plate (202) back to its vertical position.

In FIG. 3, connections (not shown) from each coil (213*a, b*) are fed into the protective housing (209) and connected to the microcontroller (not shown) and battery pack (221). A power button (222) turns on the microcontroller, transceiver and circuitry (not shown) inside housing partition (228), antenna (214), and target plate backlighting RGB LEDs (224).

In FIGS. 2 and 3, the electromagnet (211) is bolted with a washer and nut (220) to the protective housing (209) for quick disassembly and maintenance.

Target assembly (200) includes a ring of RGB LEDs (224) (not shown in FIG. 2) backlighting the target plate (202). The RGB LEDs are preferred for their bright display visible to the shooters over other lighting options. The target plate (202) may have a ring of 1/16 inch or 3/32 inch holes drilled through and plugged with clear fiber optic filament (223). The small hole diameters serve the purpose of blocking the projectile or bullet from penetrating the steel holes. The fiber optic filament (223) used may be clear or colored depending on application. Any polymer optical fiber can be chosen as long is its width matches the diameter of the holes bored in the steel plate (202).

In FIG. 3, a circular printed circuit board ("PCB") (226) with RGB LEDs (224) mounted to it is affixed to a high density foam padding layer (225) at least 1/8 inch thick which is also affixed to the steel plate with an appropriate adhesive. The foam padding layer (225) has holes cut such that the holes (not separately shown) and the fiber optic filament (223) and LED PCB ring (226) are oriented together allowing light to pass from LED to the front of the target plate (202) unimpeded. The preferred embodiment is to use full color addressable LED's. The LEDs are then connected using power and signal wires (227) (FIG. 3 only) oriented away from exposure from shrapnel and wired into the microcontroller in housing partition (209).

Figure 4:
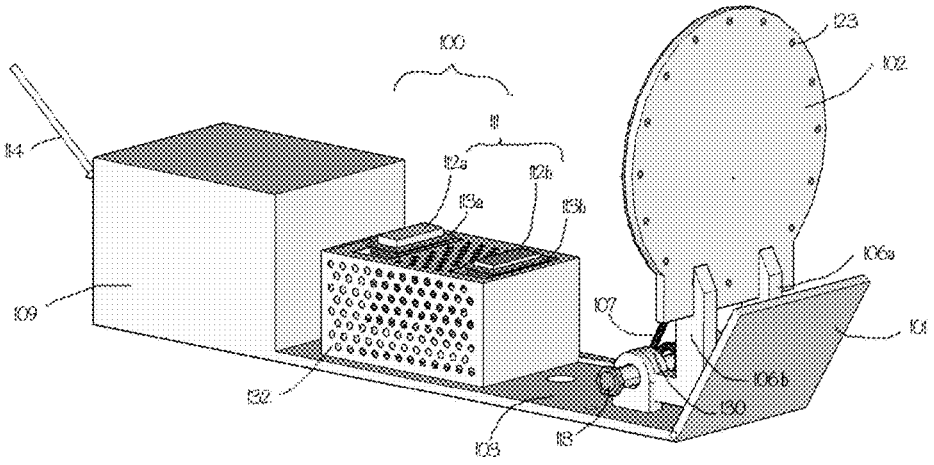
FIG. 4 shows a forward perspective view of a ground based target assembly.
Figure 5:
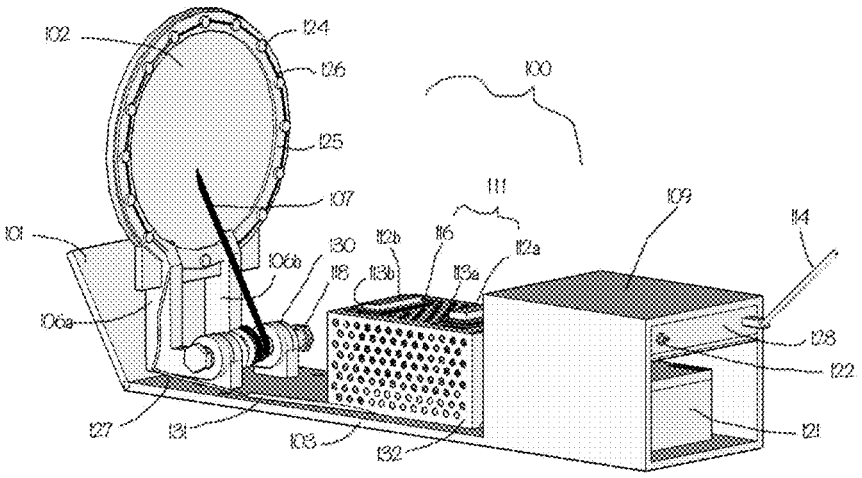
FIG. 5 shows a rear perspective view of a ground based target assembly.

FIG. 4 and FIG. 5 show a second exemplary embodiment which is a ground based target assembly (100). Target assembly (100) is using a similar popup design as target assembly (200) from FIGS. 2 and 3. Target assembly (100), employs an 8 inch in circumference and 1/2 inch thick steel plate (102) capable of taking impacts from rifle caliber projectiles. Target plate (102) articulates around shaft (118) and is drawn back up by spring (107). Like target assembly (200), this target assembly's (100) electromagnet (111) when supplied with power will lock the target plate (102) into its magnetic field when a projectile forces the plate down against spring (107). This embodiment employs a perforated metal shroud (132) to protect the electromagnet (111) from debris while also allowing cooling management. Electromagnet (111) has core legs (112 *a,b*) that sit slightly above shroud (132) while coils (113*a,b*) sit below shroud for protection. Shroud (132) is bolted to target base (103) for easy disassembly. Target base (103) includes a deflection plate (101) and mounting brackets (130) to connect arms (106*a,b*) with shaft (118).

In FIG. 5, Wiring harness (127) connects PCB LED ring (125) to the microcontroller (128) within protective housing (109) partition (128) and also to battery (121). Wiring harness (127) has a protective wiring shield (131) to protect from debris.

DETAILED DESCRIPTION OF THE INVENTION

This invention adds several innovations to the interactivity and feedback for the shooter using variations of the popup target. One, in the form of backlighting the steel target using individually addressable RGB LEDs signaling to the target shooter or shooters where the target is and the various states of the target based on the color or pattern which we will describe in more detail below. Second, it adds an electromagnet to the base of the target assembly to capture and hold the target plate down after a projectile strike. Both of these features are controlled through a main controller running training drills and various game modes over RF links.

The preferred target assembly includes a target base, a spring drawn target face plate, an electromagnet, an DC power source such as a 12 volt lead acid, a plurality of sensors to detect projectile hits, an array of addressable lights set behind target face plate, and a microcontroller or programmable logic controller ("PLC").

This target design in one preferred embodiment comprises a 6 inch in circumference 1/4 inch thick pop-up target utilizing a spring to draw the target plate back to its upright position after being struck by a projectile. This target size is optimal for pistol calibers in that the force of the bullet has enough energy to knock the plate down quickly and without any other mechanical aid. By adding an electromagnet to the target base, the target plate, when struck by a projectile, can retract and stay retracted by the magnetic field of the electromagnet, providing clear feedback to the shooter that the target was hit. Coupled with hit detection sensors, targets can either go down on the first hit or be programmed to bounce back immediately requiring a second shot before the target stays retracted.

This method of capturing a target face using electromagnets lends itself to a flexible and reactive mechanism for capturing and releasing targets. It also provides the means for resetting all targets sitting in any location with one command from the central controller over RF links or by releasing specific target plates determined by the rules of the training simulation or game mode. The electromagnet also provides its own hit detection sensor since when a target face rapidly hits and connects with the electromagnet, it causes a quick spike in voltage. This voltage can be measured and used to register hits for point scoring.

A second and equally preferred embodiment comprises an 8 inch in circumference 3/4 inch thick steel plate spring drawn pop-up target. The larger target plate is optimal for rifle calibers delivering more force per strike. The larger plate may utilize a slightly larger electromagnet to capture the target plate.

The electromagnet is connected to a microcontroller or PLC which controls when power is applied to the electromagnet. The DC power source is optimally performed by a 12 volt 8000 mAh battery housed in a ballistic shelter towards the rear of the target assembly. It is the preferred embodiment to have ease of portability thus this design is supported by a battery lending itself to supporting many target assemblies on a range all communicating with a main controller over RF links. In this way, several target assemblies can be arranged in any order on the range. However alternative embodiments may be connected to an AC source coupled with a converter and cables running from target to main controller.

Multi-colored LEDs backlighting several placed target assemblies can give the target shooters visual feedback as to the state and progress of the training or game mode they are in. Solid green on any one target can for example signal to the shooters that the target is available to be shot by any shooter. Each target can be assigned a particular color or a set of colors by the main controller to aid in training drills or various game modes. Flashing red by all target assemblies can signal to the shooters that the training simulation or game has ended.

Individually addressable RGB LED lights in our preferred embodiment are mounted on a PCB ring and affixed to the shock resistant foam or rubber pad. Power and control wires for the LEDs run down and behind the target and onto or through the target base such that when the target plate articulates to its retracted position, it doesn't interfere with the wire placement and minimizes exposure to shrapnel from projectiles. These wires are wired into the microcontroller for signal and power.

By placing several of the target assemblies mentioned above in a target range, and along with the use of the main controller connected to a computer, we create a system of targets all receiving instructions from the main controller based on training mode or game mode rules as to the particular lighting displayed and target plate orientation. Hit point data is sent back to the controller for scoring during projectile strikes. The computer is individually controlling each target assembly. The microcontroller aboard each target assembly also connects to all hit detection sensors. It also communicates with the main controller through a transceiver to control the lighting system and electromagnet.

The main controller is connected to a computer, tablet, or smartphone running software which allows users to select a training simulation or game type. The controller starts the training or game mode by preparing shooters to begin through the use of audible timers, colored lights on the target faces, with targets vertically positioned and facing the shooter. When the training or game begins, shooters will engage the targets according to the rules of the training or game type selected.

For example, a single player game type might be 'Whack a mole', whereby the game mode will release and present one target in the field that is backlit in green light. When it detects that target was hit via hit detector sensors, a second randomly selected target will be presented. This may go on for a predefined time until the game stops and all targets plates are released to their vertical position and lit red signalling the end. Scoring is tabulated by factoring hit detections in addition to timing rules and is displayed to the shooter on the computer or tablet.

An example training mode designed to improve the shooters reactivity under stress is to display a green target that dims to dark in a specified timeframe indicating to the shooter a certain amount of time to engage a target. Once dimmed, the target turns red indicating the window of opportunity is over.

Another example game type is a cooperative game type where all shooters operating as a team shoot and knock down waves of targets being presented. After each wave, difficulty increases with more targets being released to their vertical position to knock down and in less time. Game ends when shooters have failed to shoot all targets during a wave in the predetermined timeframe. In this game type, shooters are competing against themselves and for their best time.

Another example game type is one vs. one or team vs team. In this game type, each team selects a team color such as red or blue. It is each team's responsibility to shoot the color of the opposite team to gain point control. This goes on for a predetermined amount of time and which ever team hits more of the opposite team's targets wins. Team progress can be reported to all shooters using varied levels of dimness or brightness or by changing the team's color entirely, for example each hit on the red team changes their team's color to shades of orange and the blue team's color changes to shades of violet. The first team to change the color of the opposite team wins.

Controlling the use of color and orientation of the target face can aid in progressing the shooters through a training or game mode in a safe and orderly manner. Blinking white on 1 second intervals on vertically oriented targets can indicate a countdown before a training simulation or game mode begins. Flashing green 3 times fast can indicate a training or game mode has just begun. Releasing all targets to their upright position while flashing red several times can indicate to shooters that the training or game mode has ended. In addition, as an additional safety measure, A range master or referee operating the computer or tablet can interrupt an ongoing game by canceling it, thereby releasing all targets immediately to their vertical position and producing a cumulative red flash among all targets on the field, to indicate caution to the shooters that there is a safety or other necessary interruption event.

Other embodiments for a target assembly could be any in which a target plate swings or rotates into a retracted position to connect with an electromagnet. Target plates can be any shape or size so long as it has a mating surface to connect to the electromagnet for a firm magnetic connection.

Software to run the training scenarios and game modes may be of many varieties depending on the platform. IOS and Android are popular platforms as tablets lend themselves as the optimum display while in the field. It may connect to a microcontroller using bluetooth. A microcontroller was chosen for its ability to update firmware so that it may accommodate new scenarios and game modes. An API is available allowing a means for the community to add their own game modes.

When the software initializes, it first pings all available targets to identify themselves. The software ID's each target assembly and establishes a communication link. In this way, a variable number of targets can be added to a range for use. Prior to starting a training sequence or game mode, the shooter or range master may position each target on the field to a relative position on the GUI using drag and drop or other means for positioning. Once game mode is selected, a real time feedback of target states and their positions in the field can be displayed on the table. When the training sequence or game mode ends, scores are tabulated and presented.

One of ordinary skill in the art will readily recognize that equivalents of the materials and parts herein may be used, and still be with the spirit and scope of the invention.

What is claimed is:

1. A target assembly, designed for sport shooting and training, comprising a target plate having a face portion and which is itself magnetizable, pivotally connected to a base of a target platform by means of a spring and shaft, the base of the target platform comprising a base plate, an electromagnet and at least one first sensor capable of registering a hit by a projectile, the electromagnet and first sensor operatively connected to a microcontroller, a transceiver and a local power source, wherein, when the electromagnet has power and the face portion of the target plate is hit by a projectile, the target plate pivots until it is stopped and retained by the electromagnet, and also wherein, when the target plate is hit by a projectile, the registered hit is communicated by the microcontroller to the shooter informing of the hit status by activating or deactivating shooter-facing or shooter-visible multi-color light-emitting diodes, the registered hit also being communicated by the microcontroller and the transceiver to a main controller, whereby the main controller may send an instruction to the local power source to cut power to the electromagnet and release the magnetizable portion of the target plate and reactivate or deactivate the multi-colored light emitting diodes informing the shooter of the target state, wherein the electromagnet has two legs, tops of which stop and retain said target plate due to closure of the loop of the magnetic field until power to the electromagnet is cut;

wherein the said at least one first sensor includes voltage measurement means connected to the electromagnet to measure a voltage spike associated with rapid connection of the target plate, when hit, with the electromagnet; and wherein the said multi-color light-emitting diodes are mounted at a rear of the target plate on a shock-resistant padding layer.

2. The target assembly of claim 1, wherein the target platform further comprises one or more protective housings for the local power source, microcontroller, and transceiver.

3. The target assembly of claim 2, further comprising an angled deflection plate.

4. The target assembly of claim 1, wherein the electromagnet is capable of generating sufficient magnetic field so that, when power is supplied from the power source, the electromagnet generates sufficient attractive force to capture the magnetizable portion of the target plate when the plate has been hit by a projectile, thereby holding it in a retracted position until power is interrupted.

5. The target assembly of claim 1, further comprising a plurality of first sensors to detect hits.

6. The target assembly of claim 4, further comprising at least one second sensor to detect hits.

7. The target assembly of claim 1, wherein the local power source is any one of DC or AC power sources.

8. The target assembly of claim 1, wherein the target plate has at least one opening to enable emitted light from said multi-color light-emitting diodes, when energized, to be seen from the face portion of the target plate.

9. The target assembly of claim 8, wherein the target plate has a plurality of said openings.

10. The target assembly of claim 8, wherein the padding layer has at least one opening therethrough which is aligned with the said at least one opening of the target plate to enable the passage of emitted light from said multi-color light-emitting diodes.

11. The target assembly of claim 10, wherein said aligned openings have a diameter which is smaller than said projectile.

* * * * *